US011364985B2

(12) United States Patent
Azuma et al.

(10) Patent No.: US 11,364,985 B2
(45) Date of Patent: Jun. 21, 2022

(54) JET PROPELLED BOAT

(71) Applicant: YAMAHA HATSUDOKI KABUSHIKI KAISHA, Iwata (JP)

(72) Inventors: Yo Azuma, Shizuoka (JP); Masaru Suzuki, Shizuoka (JP); Tomohiro Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 79 days.

(21) Appl. No.: 17/099,811

(22) Filed: Nov. 17, 2020

(65) Prior Publication Data

US 2021/0197941 A1 Jul. 1, 2021

(30) Foreign Application Priority Data

Dec. 25, 2019 (JP) ..... JP2019-234075

(51) Int. Cl.

| | |
|---|---|
| ***B63H 11/02*** | (2006.01) |
| ***B63B 3/48*** | (2006.01) |
| ***B63B 34/10*** | (2020.01) |
| ***B63H 21/36*** | (2006.01) |
| ***B63B 5/24*** | (2006.01) |

(52) U.S. Cl.

CPC ..... *B63H 11/02* (2013.01); *B63B 3/48* (2013.01); *B63B 5/24* (2013.01); *B63B 34/10* (2020.02); *B63H 21/36* (2013.01)

(58) Field of Classification Search

CPC ..... B63H 11/02; B63H 21/36; B63B 34/10; B63B 3/48; B63B 5/24

See application file for complete search history.

(56) References Cited

U.S. PATENT DOCUMENTS

| | | | | | |
|---|---|---|---|---|---|
| 5,372,082 | A * | 12/1994 | Hattori | B63H 21/213 | 114/144 R |
| 5,537,948 | A * | 7/1996 | Kobayashi | F02B 61/045 | 440/89 C |
| 2002/0053310 | A1* | 5/2002 | Ibata | B63B 34/10 | 114/55.53 |
| 2006/0086300 | A1* | 4/2006 | Nash | B63B 19/14 | 114/201 R |
| 2013/0032080 | A1* | 2/2013 | Lee | B63B 19/14 | 114/201 R |
| 2017/0174290 | A1* | 6/2017 | Kato | B63B 34/10 | |

FOREIGN PATENT DOCUMENTS

| | | | | | |
|---|---|---|---|---|---|
| JP | 2599336 | B2 * | 4/1997 | B63B 1/042 | |
| JP | 2000053080 | A * | 2/2000 | B63B 35/73 | |
| JP | 2017-114141 | A | 6/2017 | | |
| JP | 2017114141 | A * | 6/2017 | B63B 1/042 | |
| WO | WO-2007068117 | A1 * | 6/2007 | B63B 35/73 | |

* cited by examiner

*Primary Examiner* — S. Joseph Morano
*Assistant Examiner* — Jovon E Hayes
(74) *Attorney, Agent, or Firm* — Keating and Bennett, LLP

(57) ABSTRACT

A jet propelled boat includes a boat body, a hatch, a pair of front end movement restrictors spaced apart from each other in a right-left direction in a vicinity of a front end of the hatch so as to restrict movement of the front end with respect to the deck, a rear end lock provided in a vicinity of a rear end of the hatch so as to restrict upward movement of the rear end, and a pair of rear end movement restrictors provided on both sides of the rear end lock in the right-left direction so as to restrict horizontal movement of the rear end.

17 Claims, 6 Drawing Sheets

92-92 CROSS-SECTION

ENLARGED PORTION K

JET PROPELLED BOAT

CROSS REFERENCE TO RELATED APPLICATIONS

This application claims the benefit of priority to Japanese Patent Application No. 2019-234075 filed on Dec. 25, 2019. The entire contents of this application are hereby incorporated herein by reference.

BACKGROUND OF THE INVENTION

1. Field of the Invention

The present invention relates to a jet propelled boat, and more particularly, it relates to a jet propelled boat including a hatch.

2. Description of the Related Art

A jet propelled boat including a hatch is known in general. Such a jet propelled boat is disclosed in Japanese Patent Laid-Open No. 2017-114141, for example.

Japanese Patent Laid-Open No. 2017-114141 discloses a small planing boat including an engine hood (hatch) to cover an engine room from above.

Although not clearly described in Japanese Patent Laid-Open No. 2017-114141, conventionally, there is a jet propelled boat including a pair of restrictors spaced apart from each other in a right-left direction at a front end of a hatch and a lock provided at a rear end of the hatch. In the jet propelled boat, the hatch is locked so as not to be disengaged from a boat body while movement of the front end of the hatch with respect to the boat body is restricted by the pair of restrictors, and upward movement of the rear end of the hatch with respect to the boat body is restricted by the lock. When such a pair of restrictors and such a lock are applied to the jet propelled boat disclosed in Japanese Patent Laid-Open No. 2017-114141, the hatch swings in a horizontal direction, and the hatch collides with a deck to cause a collision sound.

SUMMARY OF THE INVENTION

Preferred embodiments of the present invention provide jet propelled boats that each significantly reduce or prevent a collision sound caused by collision between a hatch and a deck due to vibrations during operation of the jet propelled boats.

A jet propelled boat according to a preferred embodiment of the present invention includes a boat body including a hull and a deck above the hull, a hatch on the deck, a pair of front end movement restrictors spaced apart from each other in a right-left direction in a vicinity of a front end of the hatch so as to restrict movement of the front end with respect to the deck, a rear end lock provided in a vicinity of a rear end of the hatch to lock the hatch so as to prevent removal of the hatch from the deck by restricting upward movement of the rear end with respect to the deck, and a pair of rear end movement restrictors provided on the hatch closer to the rear end lock than the pair of front end movement restrictors in a forward-rearward direction, the pair of rear end movement restrictors being located on both sides of the rear end lock in the right-left direction so as to restrict horizontal movement of the rear end.

A jet propelled boat according to a preferred embodiment of the present invention includes the pair of rear end movement restrictors provided on the hatch closer to the rear end lock than the pair of front end movement restrictors in the forward-rearward direction so as to restrict horizontal movement of the rear end. Accordingly, in a state in which the front end movement restrictors restrict movement of a front portion of the hatch and the rear end movement restrictors restrict horizontal movement of a rear portion of the hatch, the rear end lock locks the hatch with respect to the deck. Thus, in a state in which not only movement of the front portion of the hatch but also horizontal movement of the rear portion of the hatch is restricted, the rear end lock locks the hatch with respect to the deck, and thus collision between the hatch and the deck caused by horizontal swinging of the hatch due to vibrations during operation is significantly reduced or prevented. Consequently, sounds caused by collision between the hatch and the deck due to vibrations during operation are significantly reduced or prevented. Furthermore, the pair of rear end movement restrictors are provided on both sides of the rear end lock in the right-left direction such that horizontal swinging of the hatch due to vibrations during operation is reliably significantly reduced or prevented.

In a jet propelled boat according to a preferred embodiment of the present invention, the hatch preferably includes an engine hatch to cover an engine storage chamber provided in the boat body from above. Accordingly, horizontal swinging of the engine hatch due to vibrations during operation is significantly reduced or prevented.

In a jet propelled boat according to a preferred embodiment of the present invention, the pair of rear end movement restrictors are preferably provided in the vicinity of the rear end of the hatch on right and left sides of the rear end lock. Accordingly, the rear end movement restrictors are provided in the vicinity of the rear end of the hatch, and thus the rear end movement restrictors are positioned farthest from the front end movement restrictors in the forward-rearward direction. Therefore, as compared with a case in which the rear end movement restrictors are located in the vicinity of portions of the hatch forward of the rear end, horizontal swinging of the rear portion of the hatch due to vibrations during operation is further significantly reduced or prevented. Consequently, sounds caused by collision between the hatch and the deck due to vibrations during operation are effectively significantly reduced or prevented.

In a jet propelled boat according to a preferred embodiment of the present invention, the pair of rear end movement restrictors are preferably provided outward of the pair of front end movement restrictors in the right-left direction. Accordingly, the pair of rear end movement restrictors are spaced apart by a relatively large distance in the right-left direction, and thus horizontal swinging of the rear portion of the hatch due to vibrations during operation is more reliably significantly reduced or prevented.

In such a case, the pair of rear end movement restrictors are preferably provided in the vicinity of both sides of the hatch in the right-left direction, respectively. Accordingly, the pair of rear end movement restrictors are more largely spaced apart in the right-left direction, and thus horizontal swinging of the rear portion of the hatch due to vibrations during operation is more reliably significantly reduced or prevented.

In a jet propelled boat according to a preferred embodiment of the present invention, the pair of rear end movement restrictors each preferably include a tubular portion provided on one of the deck and the hatch and including a hole that extends in an upward-downward direction, and a boss-shaped portion provided on the other of the deck and the hatch and inserted into the tubular portion such that horizontal movement of the boss-shaped portion is restricted. Accordingly, the boss-shaped portion is easily inserted into the tubular portion such that horizontal swinging of the hatch is significantly reduced or prevented. Thus, horizontal swinging of the hatch is easily significantly reduced or prevented.

In such a case, the tubular portion is preferably separate from the deck and is preferably fixed to the deck, and the boss-shaped portion is preferably integral and unitary with the hatch. Accordingly, the tubular portion is provided as structure on the deck side without changing the shape of the deck. Furthermore, the boss-shaped portion is provided together with the hatch, and thus the boss-shaped portion is easily provided.

In a jet propelled boat including the tubular portion that is separate from the deck and is fixed to the deck, and the boss-shaped portion that is integral and unitary with the hatch, the hatch preferably includes an engine hatch to cover an engine storage chamber provided in the boat body from above, the engine hatch preferably includes an inner hatch and an outer hatch located above the inner hatch, and the pair of rear end movement restrictors each preferably further include a fixing member to fix the inner hatch and the outer hatch to each other, in addition to the tubular portion and the boss-shaped portion. Accordingly, the inner hatch and the outer hatch are easily fixed to each other by the fixing member, which is the structure of each of the rear end movement restrictors.

In a jet propelled boat including the engine hatch that includes the inner hatch and the outer hatch, the outer hatch and the inner hatch preferably include an outer fixing portion to which the fixing member is attached and a hollow inner fixing portion, respectively, and are preferably fixed to each other by the fixing member in a state in which the outer fixing portion is placed inside the inner fixing portion from above, and the pair of rear end movement restrictors preferably restrict horizontal movement of the rear end of the engine hatch by inserting the boss-shaped portion that functions as the inner fixing portion into the tubular portion in a state in which the outer hatch and the inner hatch are fixed to each other by the fixing member. Accordingly, the inner fixing portion also functions as the boss-shaped portion, and thus the structure is simplified as compared with a case in which the inner fixing portion and the boss-shaped portion are provided separately.

In a jet propelled boat including the inner hatch and the outer hatch fixed to each other by the fixing member, the fixing member preferably includes a bolt screwed into the outer fixing portion from below in a state in which the bolt is placed inside the tubular portion so as to jointly fasten the inner hatch and the outer hatch. Accordingly, the inner hatch and the outer hatch are easily jointly fastened (fixed to each other) by the bolt, which is a general-purpose product.

In a jet propelled boat including the fixing member that includes the bolt to jointly fasten the inner hatch and the outer hatch, the outer fixing portion preferably includes a thicker portion including a female screw into which the bolt is screwed, the thicker portion being thickened in a direction in which the female screw extends. Accordingly, the large female screw is provided due to the thicker portion, and thus the inner hatch and the outer hatch are more firmly fixed to each other.

In a jet propelled boat including the fixing member that includes the bolt to jointly fasten the inner hatch and the outer hatch, the boss-shaped portion preferably has a concave shape that is recessed upward, and includes, at its tip end, a bolt head storage to accommodate a head of the bolt.

Accordingly, the boss-shaped portion is inserted deeper into the tubular portion as compared with a case in which the length of the boss-shaped portion is reduced by the size of the head of the bolt. Therefore, the inserted state of the boss-shaped portion into the tubular portion is more reliably maintained.

In a jet propelled boat including the tubular portion that is separate from the deck and is fixed to the deck, and the boss-shaped portion that is integral and unitary with the hatch, both the hatch and the tubular portion are preferably made of a resin material. Accordingly, the hatch (boss-shaped portion) and the tubular portion are made of the same or similar materials, and thus wear of both the hatch (boss-shaped portion) and the tubular portion due to contact is significantly reduced or prevented. Furthermore, the hatch and the tubular portion are easily provided by injection molding of a resin using a mold.

In a jet propelled boat including the rear end movement restrictors that each include the tubular portion and the boss-shaped portion, the boss-shaped portion preferably has a diameter larger than a length of the tubular portion in the upward-downward direction. Accordingly, the diameter of the boss-shaped portion is relatively large, and thus the strength of the boss-shaped portion is enhanced.

In such a case, the diameter of the boss-shaped portion is preferably larger than twice the length of the tubular portion in the upward-downward direction. Accordingly, the boss-shaped portion has a larger diameter, and thus the strength of the boss-shaped portion is effectively enhanced.

In a jet propelled boat including the rear end movement restrictors that each include the tubular portion and the boss-shaped portion, the boss-shaped portion preferably includes a tip end including a rounded and curved outer edge. Accordingly, the outer edge of the tip end of the boss-shaped portion, which is a portion first inserted into the tubular portion, has a rounded and curved shape such that the boss-shaped portion is easily inserted into the tubular portion.

In a jet propelled boat including the rear end movement restrictors that each include the tubular portion and the boss-shaped portion, the boss-shaped portion preferably has a tapered shape that gradually tapers toward a tip end of the boss-shaped portion, and the hole of the tubular portion preferably gradually tapers along the boss-shaped portion. Accordingly, the tip end of the boss-shaped portion, which is a portion first inserted into the tubular portion, is narrow, and thus the boss-shaped portion is easily inserted into the tubular portion.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings. In the following description, a forward-rearward direction and a right-left direction are relative to a jet propelled boat 100. The forward movement direction (FWD direction) side of the jet propelled boat 100 is defined as the front, and the reverse movement direction (BWD direction) side of the jet propelled boat 100 is defined as the rear. Furthermore, a right direction (R direction) side with respect to the forward movement direction of the jet propelled boat 100 is defined as the right, and a left direction (L direction) side with respect to the forward movement direction of the jet propelled boat 100 is defined as the left.

The structure of the jet propelled boat 100 according to preferred embodiments of the present invention is now described with reference to FIGS. 1 to 10.

Figure 1:
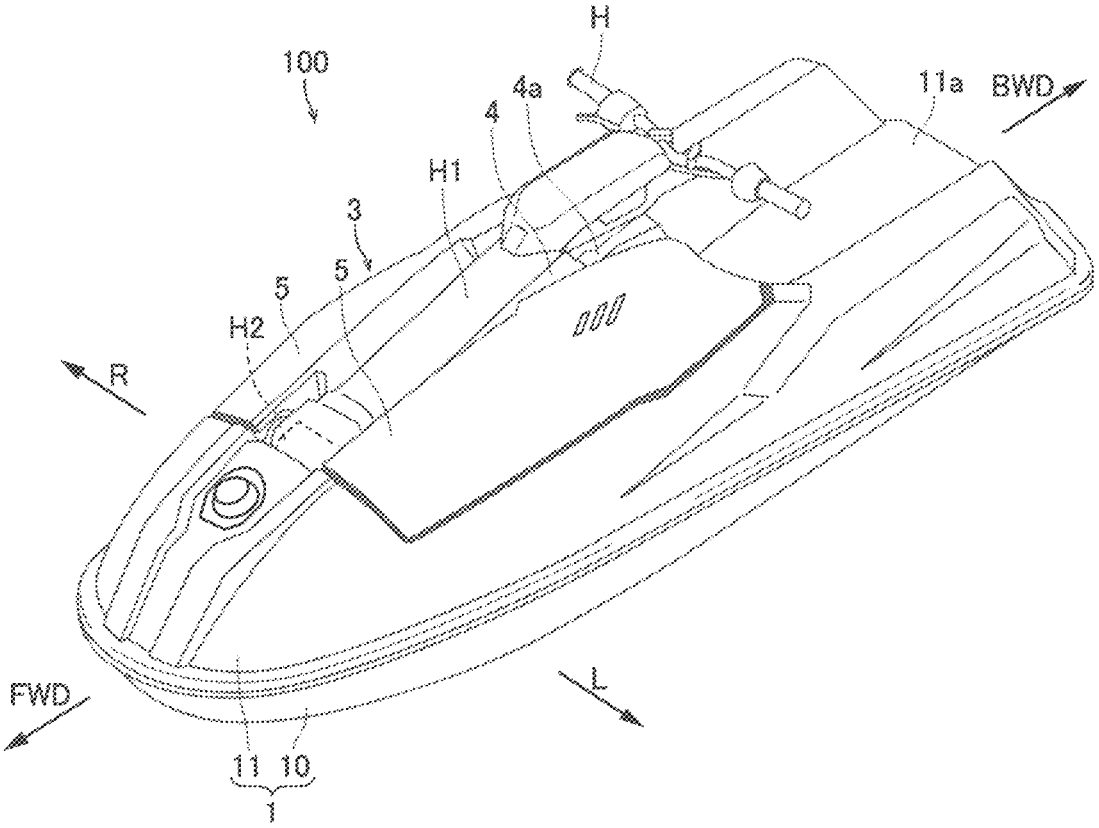
FIG. 1 is a perspective view showing a jet propelled boat according to a preferred embodiment of the present invention.
Figure 2:
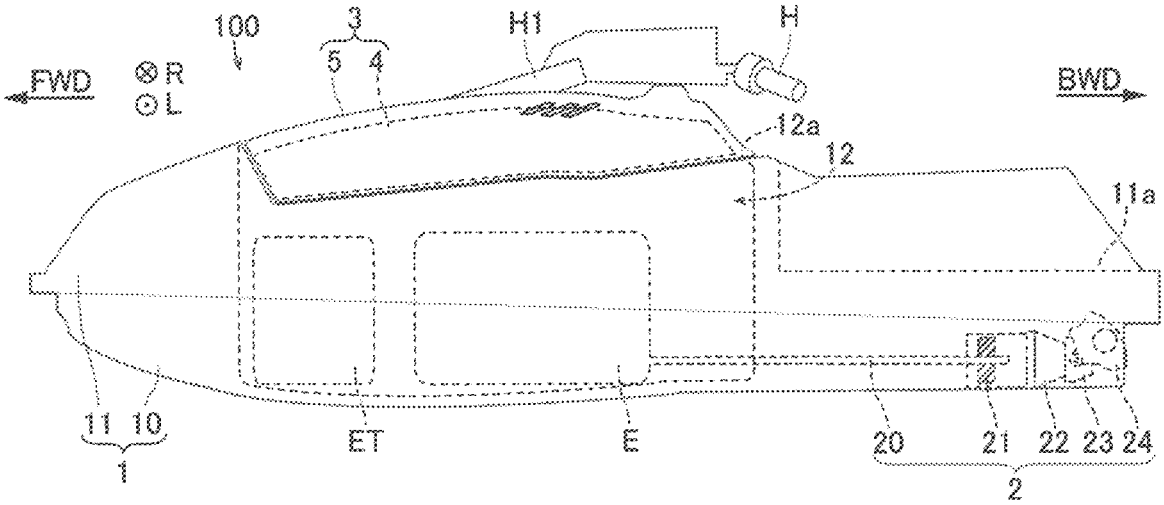
FIG. 2 is a side view showing a jet propelled boat according to a preferred embodiment of the present invention.

As shown in FIG. 1 or FIG. 2, the jet propelled boat 100 includes a boat body 1 including a hull 10 and a deck 11, a handle H, an engine E, and a jet propulsion device 2 driven by the engine E to propel the jet propelled boat 100.

Figure 3:
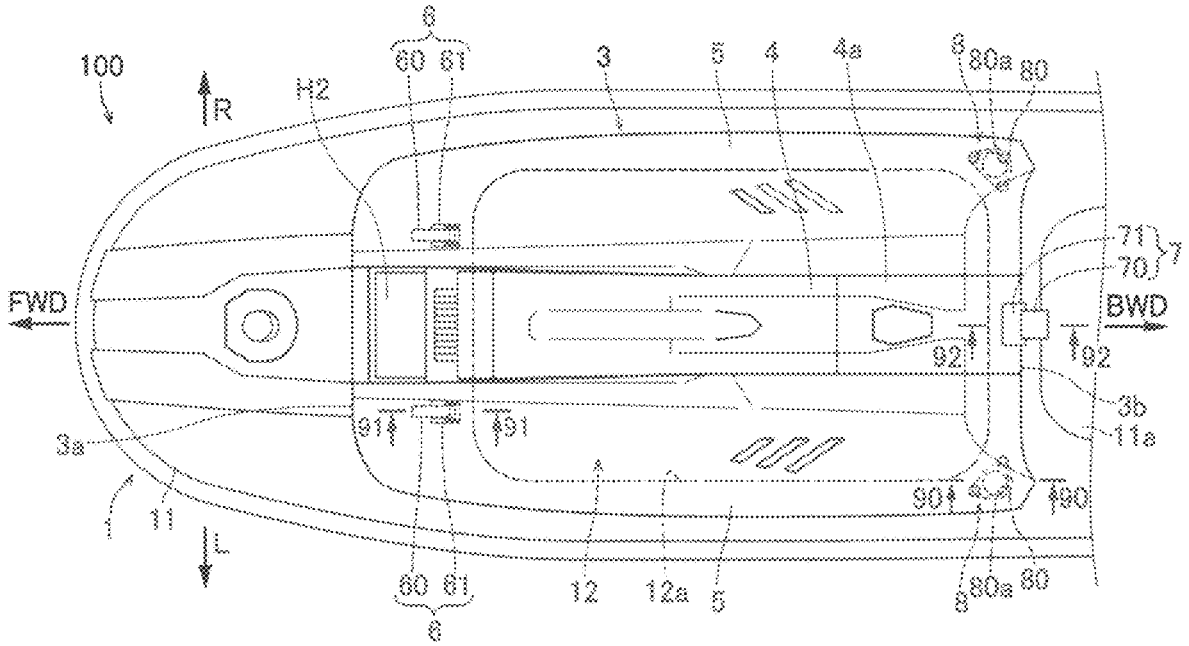
FIG. 3 is a plan view showing a state in which an engine hatch is installed on a jet propelled boat according to a preferred embodiment of the present invention.

As shown in FIG. 3, the jet propelled boat 100 includes an engine hatch 3 installed on the deck 11, front end movement restrictors 6, a rear end lock 7, and rear end movement restrictors 8. The engine hatch 3 is an example of a "hatch". In FIG. 3, the handle H and a handle pole H1 are not shown (the same applies to FIG. 4).

The front end movement restrictors 6, the rear end lock 7, and the rear end movement restrictors 8 restrict (prevent or significantly reduce) movement of the engine hatch 3 with respect to the deck 11 even when the jet propelled boat 100 is being propelled, and maintain the installed state of the engine hatch 3 on the deck 11.

As shown in FIG. 2, the hull 10 defines a lower portion of the boat body 1, and floats on the water surface. The deck 11 defines an upper portion of the boat body 1, and is installed above the hull 10. Various components such as the handle pole H1 (handle H) and the engine hatch 3 are installed on the hull 10.

An engine storage chamber 12 that stores the engine E and a fuel tank ET is provided inside the boat body 1. An opening 12*a* closed by the engine hatch 3 is provided at an upper end of the engine storage chamber 12. The opening 12*a* has a rectangular or substantially rectangular shape that is elongated in a forward-rearward direction in a plan view (as viewed from above). The jet propelled boat 100 is a one-seater but in which a seat is not (usually) provided on the hull 1. The deck 11 includes a boarding portion 11*a*, on which a user rides in a standing position, rearward of the handle H.

Figure 4:
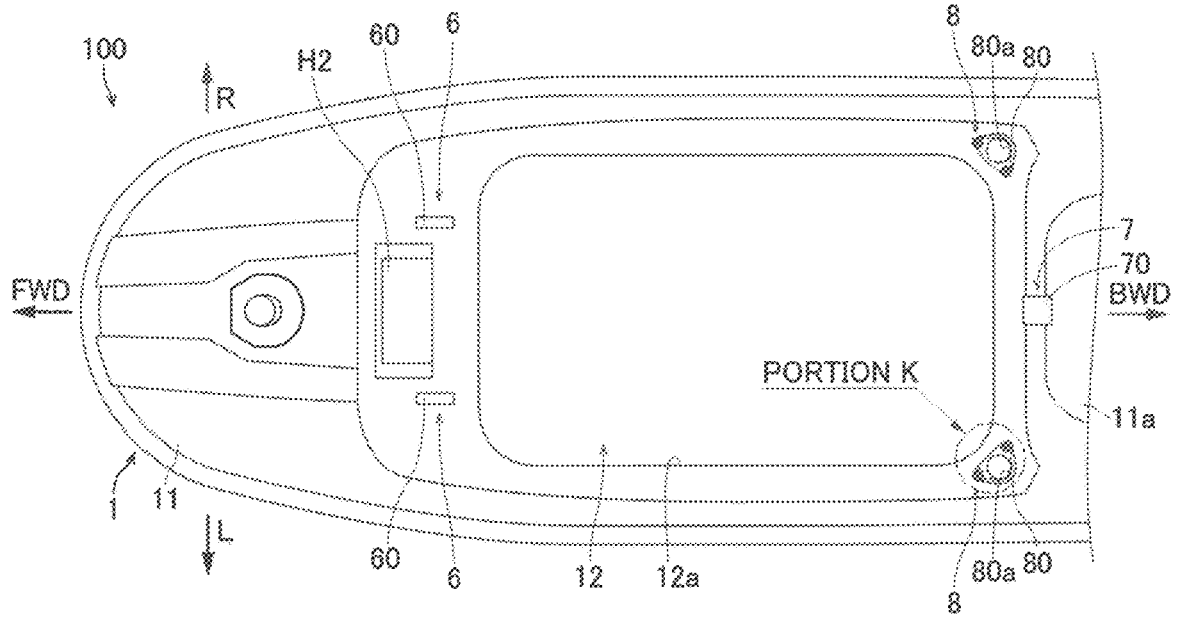
FIG. 4 is a plan view showing a state in which an engine hatch has been removed from a jet propelled boat according to a preferred embodiment of the present invention.

The deck 11 includes three types of members including deck-side front end movement restrictors 60, described below, of the front end movement restrictors 6, tubular portions 80, described below, of the rear end movement restrictors 8, and a deck-side rear end lock 70, described below, of the rear end lock 7 as members used to install the engine hatch 3 and maintain the installed state (see FIG. 4). The details are described below.

The handle H is installed on the deck 11 via the handle pole H1. The handle H is an operator gripped and operated by a crew member. Specifically, the handle H includes a function of adjusting the output of the engine E. Furthermore, the handle H includes a function of changing (adjusting) the orientations of a deflector 23 and a bucket 24, described below, of the jet propulsion device 2.

The engine E drives the jet propulsion device 2. Specifically, the engine E is an internal combustion engine driven by fuel stored in the fuel tank ET. The engine E rotationally drives a drive shaft 20 of the jet propulsion device 2 via a crankshaft (not shown) by driving a piston (not shown). The handle pole H1 is supported by a support H2 (see FIG. 1) so as to be rotatable about an axis that extends in a right-left direction.

The jet propulsion device 2 shown in FIG. 2 is driven by the engine E to suction water from a water suction port (not shown) provided in the boat body 1 and jet the suctioned water from a nozzle 22. Consequently, the jet propelled boat 100 is propelled. The jet propulsion device 2 includes the drive shaft 20, an impeller 21, the nozzle 22, the deflector 23, and the bucket 24.

A front end of the drive shaft 20 is located in the engine storage chamber 12, and the drive shaft 20 extends rearward from the inside of the engine storage chamber 12. The impeller 21 is fixed to the drive shaft 20 in the vicinity of a rear end of the drive shaft 20.

The impeller 21 is provided in the boat body 1 and is located in a water flow path (not shown) connected to the nozzle 22 on the downstream side. The impeller 21 rotates together with the drive shaft 20 to generate a flow toward the nozzle 22 in the water flow path.

The nozzle 22 is located at the most downstream position of the water flow path in which the impeller 21 is provided. The nozzle 22 functions as a water discharge port (jetting port). The nozzle 22 jets water to apply a thrust force to the boat body 1. The deflector 23 and the bucket 24 are installed on the nozzle 22.

The deflector 23 is rotatable in the right-left direction about an axis that extends in an upward-downward direction. The deflector 23 changes the direction of the water jetted from the nozzle 22 to the right-left direction. The deflector 23 rotates in the right-left direction in response to an operation on the handle H.

The bucket 24 is rotatable in the upward-downward direction about the axis that extends in the right-left direction. The bucket 24 changes the direction of the water jetted from the nozzle 22 to the forward-rearward direction. The bucket 24 rotates in the upward-downward direction in response to an operation on the handle H.

The engine hatch 3 is installed on the deck 11 of the boat body 1. The engine hatch 3 covers the engine storage chamber 12 (opening 12*a*) provided in the boat body 1 from above. The engine hatch 3 has a rectangular or substantially rectangular shape that is elongated in the forward-rearward direction. The engine hatch 3 is detachable from the boat body 1. The engine hatch 3 is made of a resin material, for example. As an example, the engine hatch 3 is made of an ABS resin.

Figure 5:
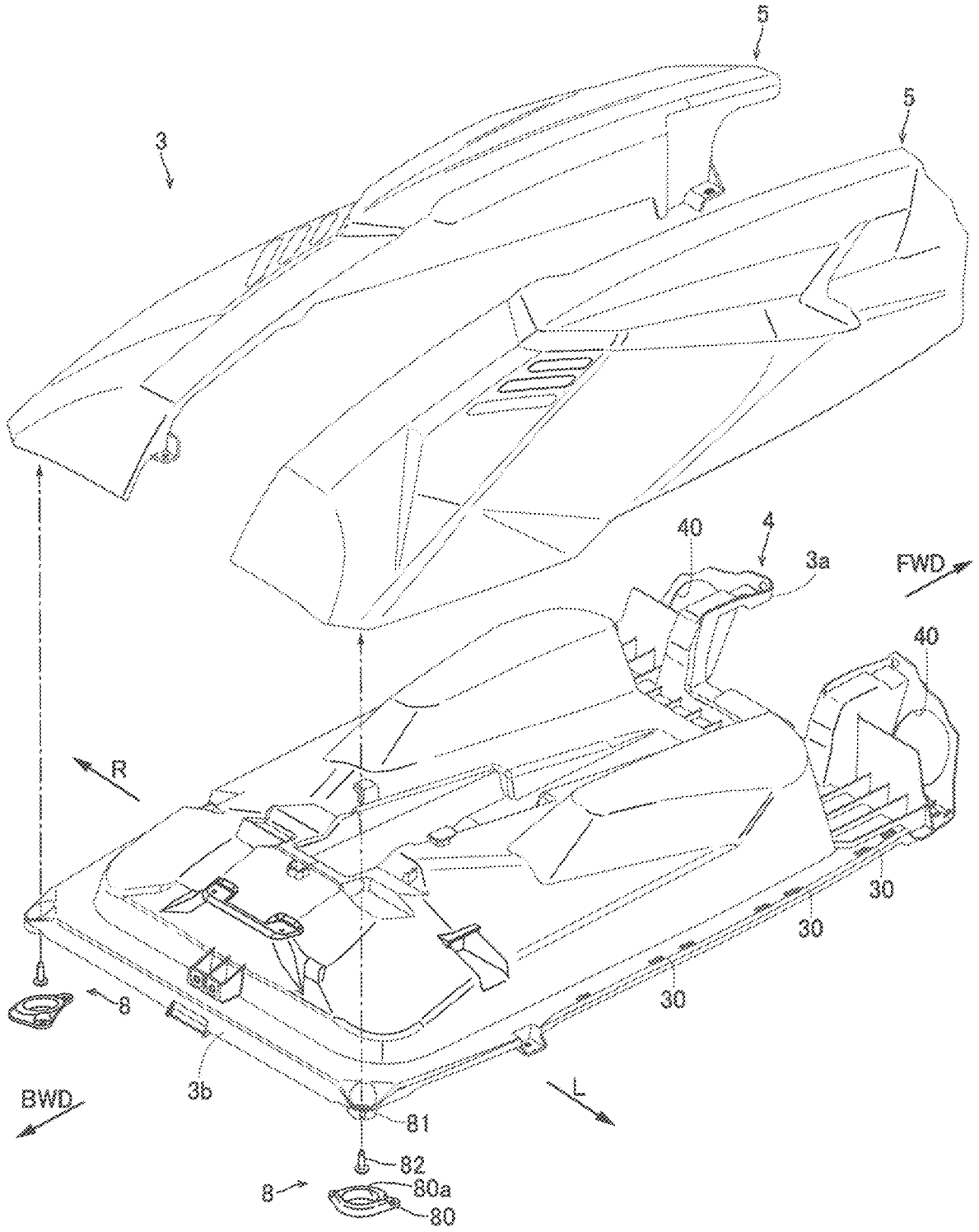
FIG. 5 is an exploded perspective view showing an engine hatch of a jet propelled boat according to a preferred embodiment of the present invention as viewed from the rear and above.

As shown in FIG. 5, the engine hatch 3 includes one inner hatch 4 and two (a pair of) outer hatches 5 located (installed) above the inner hatch 4.

The inner hatch 4 is a functional component, and is covered by the outer hatches 5 and the handle pole H1 from above so as not to be substantially exposed to the outside under normal use conditions. The inner hatch 4 is located below (inward of) the outer hatches 5 such that a gap for air to flow is provided between the inner hatch 4 and the outer hatches 5. The engine hatch 3 takes in air from air openings 40 provided on the front side and allows the air to flow through the gap into the engine storage chamber 12 (see FIG. 3). The inner hatch 4 covers the opening 12*a* (see FIG. 3) of the engine storage chamber 12 from above. The inner hatch 4 has a rectangular or substantially rectangular flat plate shape that extends in a horizontal direction (the forward-rearward direction and the right-left direction).

As shown in FIG. 3, hatch-side front end movement restrictors 61, described below, of the front end movement restrictors 6 are fixed to the inner hatch 4 in the vicinity of a front end of the inner hatch 4 (a front end 3*a* of the engine hatch 3). A hatch-side rear end lock 71, described below, of the rear end lock 7, is fixed to the inner hatch 4 in the vicinity of a rear end of the inner hatch 4 (a rear end 3*b* of the engine hatch 3). In the inner hatch 4, a cover 4*a* is installed from above between the pair of outer hatches 5.

The outer hatches 5 are exterior components. The pair of outer hatches 5 are spaced apart from each other in the right-left direction. The handle pole H1 is located between the pair of outer hatches 5. The outer hatches 5 are fixed to the inner hatch 4, and are fixed to the deck 11 via the inner hatch 4.

Figure 6:
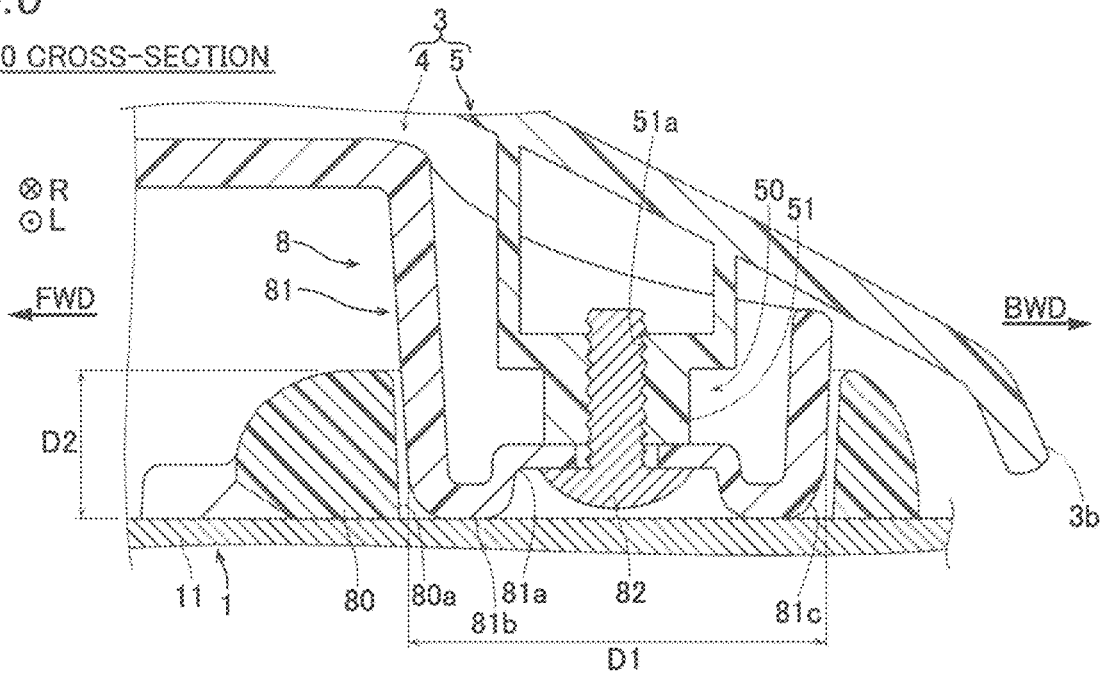
FIG. 6 is a sectional view taken along a 90-90 cross-section of FIG. 3.

Specifically, as shown in FIG. 6, the outer hatches 5 and the inner hatch 4 integrally include outer fixing portions 50 and inner fixing portions (boss-shaped portions 81), respectively, as structures to fix the outer hatches 5 and the inner hatch 4 to each other. The inner fixing portions function as the boss-shaped portions 81, described below, of the rear end movement restrictors 8.

The outer fixing portions 50 and the inner fixing portions (boss-shaped portions 81) are fixed (jointly fastened) to each other by bolts 82, for example. The inner fixing portions (boss-shaped portions 81) each have a hollow boss shape that protrudes downward. The bolts 82 are examples of a "fixing member".

The outer fixing portions 50 include thicker portions 51 including female screws 51*a* into which the bolts 82 are screwed. The female screws 51*a* extend in the upward-downward direction. The thicker portions 51 are thickened in the upward-downward direction in which the female screws 51*a* extend. In the outer hatches 5 and the inner hatch 4, lower ends of the thicker portions 51 contact the inner fixing portions (boss-shaped portions 81) from above, and the outer hatches 5 and the inner hatch 4 are fixed to each other by the bolts 82 in a state in which the outer fixing portions 50 are placed inside the inner fixing portions (boss-shaped portions 81) from above.

The outer fixing portions 50 and the inner fixing portions (boss-shaped portions 81) are located at positions that overlap each other in a plan view. A pair of outer fixing portions 50 and a pair of inner fixing portions (boss-shaped portions 81) are provided in the vicinity of a rear end of the inner hatch 4 and in the vicinity of opposite ends of the inner hatch 4 in the right-left direction.

The engine hatch 3 further includes positioning and fixing portions 30 (see FIG. 8) that position the inner hatch 4 and the outer hatches 5 and fix the inner hatch 4 and the outer hatches 5 to each other. The positioning and fixing portions 30 include a plurality of claws provided on the outer hatches 5, holes provided on the inner hatch 4 and with which the claws engage, bolts, and a plurality of bolt mounts to which the bolts are mounted.

As shown in FIG. 3, a pair of front end movement restrictors 6 are spaced apart from each other in the right-left direction in the vicinity of the front end 3*a* of the engine hatch 3. The pair of front end movement restrictors 6 are provided on a first side and a second side of the support H2 in the right-left direction so as to sandwich the support H2 that rotatably supports the handle pole H1 (see FIG. 2), respectively. The front end movement restrictors 6 restrict movement of the front end 3*a* with respect to the deck 11. The details are described below.

The front end movement restrictors 6 include the deck-side front end movement restrictors 60 provided on the deck 11 and the hatch-side front end movement restrictors 61 provided on the inner hatch 4. The hatch-side front end movement restrictors 61 engage with the deck-side front end movement restrictors 60 such that movement of the front end 3*a* of the engine hatch 3 is restricted.

The deck-side front end movement restrictors 60 are located at positions that overlap the outer hatches 5 and the inner hatch 4 and inward of the outer hatches 5 in the right-left direction in a plan view (as viewed from above). The deck-side front end movement restrictors 60 are located forward of the opening 12*a* of the engine storage chamber 12.

Figure 7:
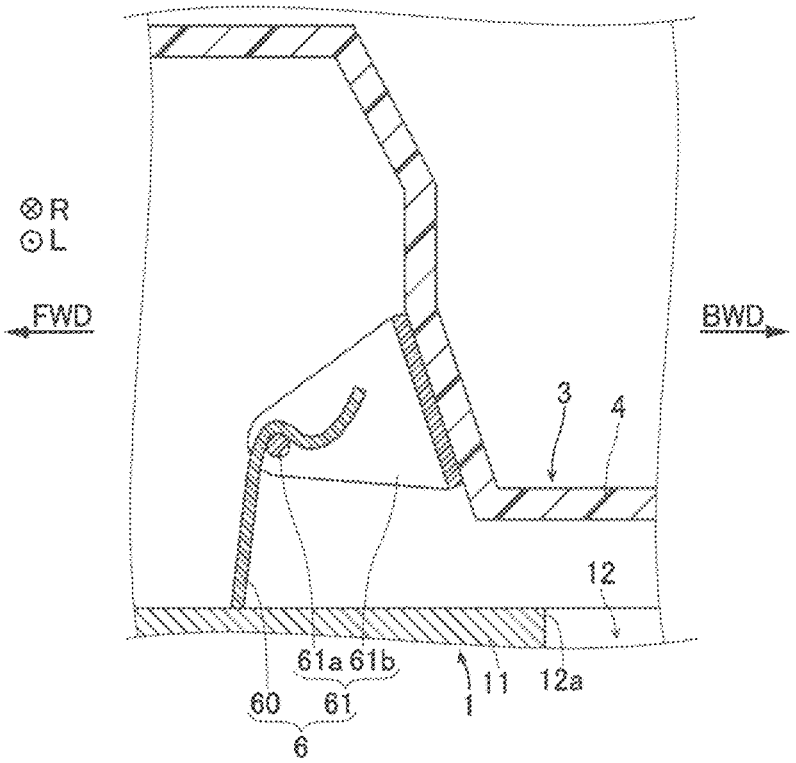
FIG. 7 is a sectional view taken along a 91-91 cross-section of FIG. 3.

As shown in FIG. 7, the deck-side front end movement restrictors 60 extend while curving in a wavy shape diagonally rearward (rearward and upward) as viewed in the right-left direction. The deck-side front end movement restrictors 60 are, for example, plate-shaped members that are thin as viewed in the right-left direction. The deck-side front end movement restrictors 60 include portions recessed upward such that the hatch-side front end movement restrictors 61 are engageable from below.

Figure 8:
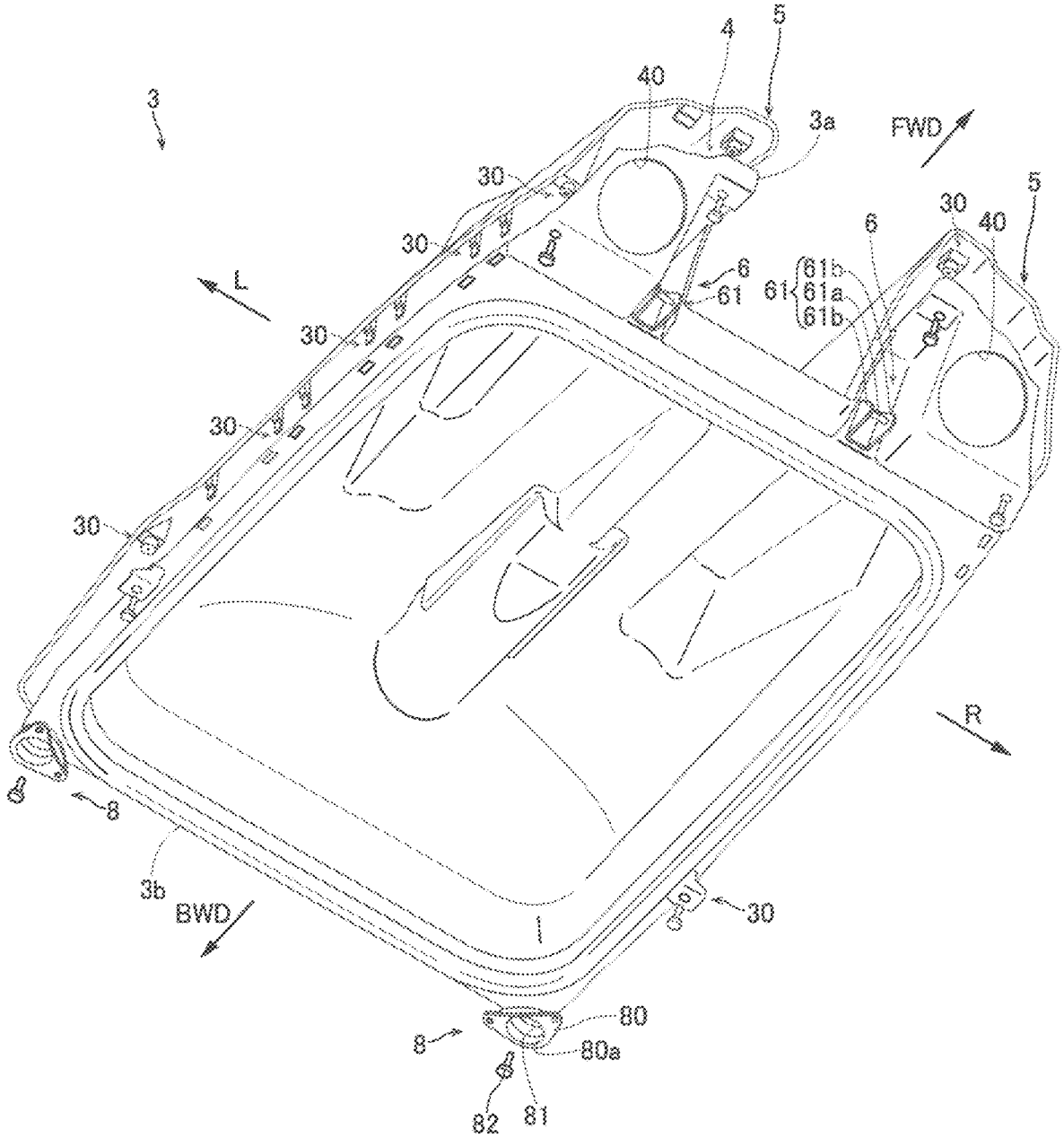
FIG. 8 is a perspective view showing an engine hatch of a jet propelled boat according to a preferred embodiment of the present invention as viewed from the front and below.

The hatch-side front end movement restrictors 61 include shafts 61*a* that extend in the right-left direction, which are engaging portions that engage with the deck-side front end movement restrictors 60, and a pair of triangular plates 61*b* that sandwich the shafts 61*a* from the right and left sides (see FIG. 8). The front end movement restrictors 6 restrict movement of the front end 3*a* (see FIG. 3) of the engine hatch 3 in the upward-downward direction and in the forward-rearward direction by engaging the shafts 61*a* (hatch-side front end movement restrictors 61) with the wavy deck-side front end movement restrictors 60.

The front end movement restrictors 6 restrict movement of the front end 3*a* of the engine hatch 3 in the right-left direction by sandwiching the wavy deck-side front end movement restrictors 60 between the pair of plates 61*b* (hatch-side front end movement restrictors 61).

As shown in FIG. 3, one rear end lock 7 is provided in the vicinity of the rear end 3*b* of the engine hatch 3. The rear end lock 7 is located in a central or substantially central portion in the right-left direction. The rear end lock 7 locks the engine hatch 3 so as to prevent removal of the engine hatch 3 from the deck 11 by restricting upward movement of the rear end 3*b* with respect to the deck 11. The details are described below.

Figure 9:
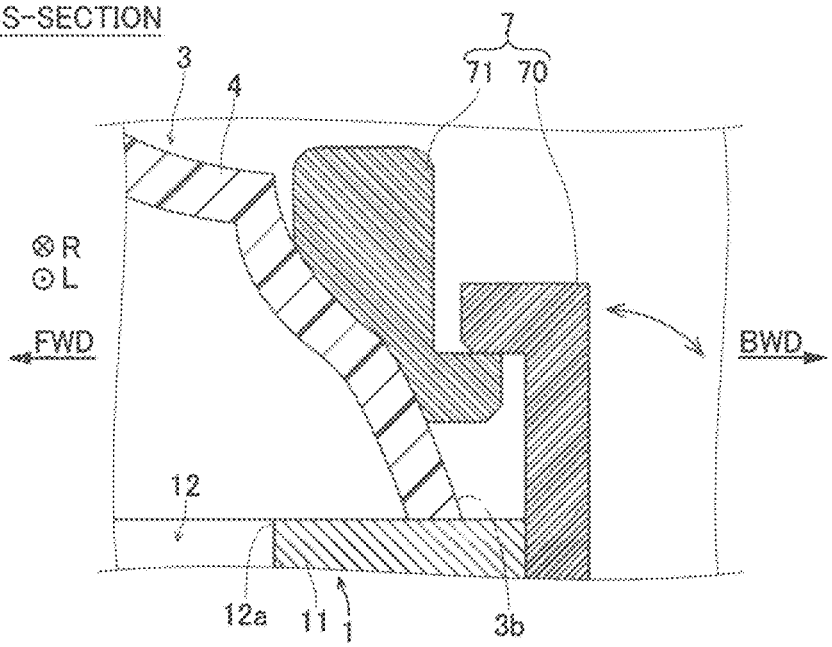
FIG. 9 is a sectional view taken along a 92-92 cross-section of FIG. 3.
Figure 10:
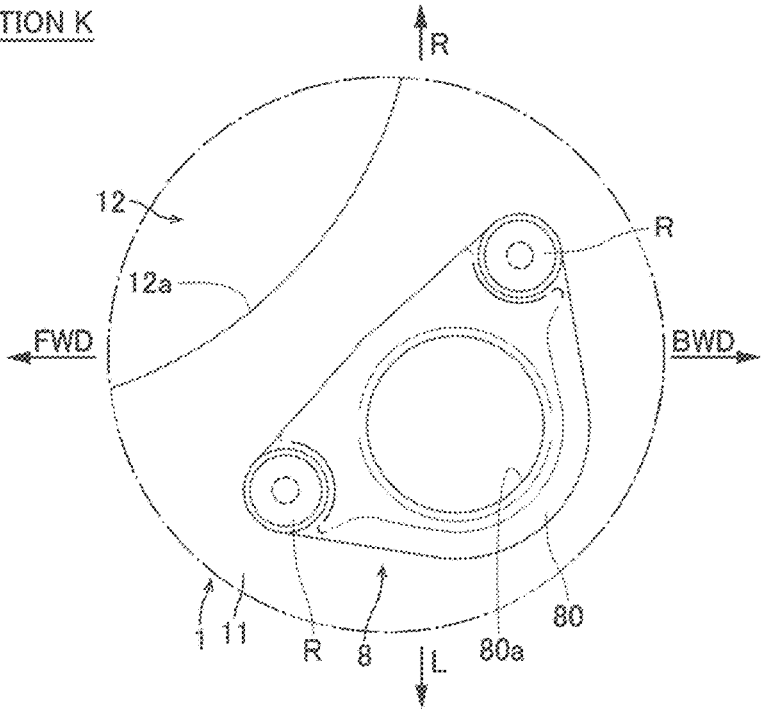
FIG. 10 is a partially enlarged view of a portion K in FIG. 4.

As shown in FIG. 9, the rear end lock 7 includes the hook-shaped deck-side rear end lock 70 provided on the deck 11 and the hatch-side rear end lock 71 provided on the inner hatch 4. The deck-side rear end lock 70 engages with the hatch-side rear end lock 71 such that movement of the rear end 3*b* of the engine hatch 3 is restricted.

Specifically, the hook-shaped deck-side rear end lock 70 is installed on the deck 11 so as to be rotatable about the axis that extends in the right-left direction. The deck-side rear end lock 70 rotates to engage with the hatch-side rear end lock 71. The deck-side front end movement restrictors 60 are located rearward of the opening 12*a* of the engine storage chamber 12.

The hatch-side rear end lock 71 is located forward of the deck-side rear end lock 70. The hatch-side rear end lock 71 includes a portion that protrudes rearward and engages with the hook-shaped deck-side rear end lock 70. The deck-side rear end lock 70 rotates to move from the rear side to the upper side such that upward movement of the hatch-side rear end lock 71 is restricted.

In the jet propelled boat 100 shown in FIG. 3, the rear end lock 7 locks the engine hatch 3 at the end of the operation to attach the engine hatch 3 to the deck 11. Specifically, in the jet propelled boat 100, the rear end lock 7 locks the engine hatch 3 with respect to the deck 11 in a state in which the front end movement restrictors 6 restrict movement of the front end 3*a* of the engine hatch 3, and the rear end movement restrictors 8 further restrict horizontal movement of the rear end 3*b* of the engine hatch 3.

The rear end movement restrictors 8 are provided on the engine hatch 3 closer to the rear end lock 7 than the front end movement restrictors 6 in the forward-rearward direction, and a pair of rear end movement restrictors 8 are provided on both sides of the rear end lock 7 in the right-left direction so as to restrict horizontal movement of the rear end 3*b* of the engine hatch 3.

The pair of rear end movement restrictors 8 are provided in the vicinity of the rear end 3*b* of the engine hatch 3 on right and left sides of the rear end lock 7. In the right-left direction, the pair of rear end movement restrictors 8 are provided outward of the pair of front end movement restrictors 6. The rear end movement restrictors 8 are located in outer portions of the outer hatches 5 in the right-left direction at positions that overlap the outer hatches 5 and the inner hatch 4 in a plan view (as viewed from above).

The pair of rear end movement restrictors 8 are provided in the vicinity of both sides of the engine hatch 3 in the right-left direction, respectively. The pair of rear end movement restrictors 8 are located in the vicinity of two rear corners of the rectangular opening 12*a* of the engine storage chamber 12, respectively.

As shown in FIG. 6, the rear end movement restrictors 8 include the tubular portions 80 provided on the deck 11, boss-shaped portions 81 provided on the engine hatch 3, and the bolts 82.

The bolts 82 fix the inner hatch 4 and the outer hatches 5 to each other. Specifically, the bolts 82 are screwed into the outer fixing portions 50 from below in a state in which the bolts 82 are placed inside the tubular portions 80 so as to jointly fasten the inner hatch 4 and the outer hatches 5.

The tubular portions 80 include holes 80*a* (through-holes) that extend in the upward-downward direction. The tubular portions 80 are separate from the deck 11. The tubular portions 80 are directly fixed to the deck 11 by a plurality of (e.g., two) rivets R (see FIG. 10). The holes 80*a* of the tubular portions 80 gradually become narrower toward the lower side so as to correspond to the tapered boss-shaped portions 81 described below. Thus, the holes 80*a* of the tubular portions 80 each have a tapered shape that becomes narrower toward the lower side.

The tubular portions 80 are made of a material that is the same or similar to the material of the boss-shaped portions 81. Specifically, the tubular portions 80 are made of a resin material. As an example, the tubular portions 80 are made of a POM resin.

The boss-shaped portions 81 are inserted into the tubular portions 80 from above such that horizontal movement of the boss-shaped portions 81 is restricted. The boss-shaped portions 81 each have a tubular external shape that protrudes downward. The boss-shaped portions 81 are integral and unitary with the inner hatch 4.

The boss-shaped portions 81 function as inner fixing portions. The rear end movement restrictors 8 restrict horizontal movement of the rear end 3*b* of the engine hatch 3 by inserting the boss-shaped portions 81 that function as inner fixing portions into the tubular portions 80 from above in a state in which the outer hatches 5 (outer fixing portions 50) and the inner hatch 4 (inner fixing portion) are fixed to each other by the bolts 82.

The boss-shaped portions 81 include bolt head storage areas 81*a* at their tip ends 81*b* (lower ends). The bolt head storage areas 81*a* each have a concave shape that is recessed upward, and accommodate the heads of the bolts 82. Therefore, surfaces of the tip ends 81*b* (surfaces at the lower ends) of the boss-shaped portions 81 are located below the heads of the bolts 82.

The boss-shaped portions 81 each have a tapered shape that gradually tapers toward the tip ends 81*b* (downward) of the boss-shaped portions 81. Thus, the boss-shaped portions 81 each have a tapered shape that becomes narrower toward the lower side. The diameters D1 (the smallest diameters of the tip ends 81*b*) of the boss-shaped portions 81 are larger than the lengths D2 of the tubular portions 80 in the upward-downward direction. Furthermore, the diameters D1 (the smallest diameters of the tip ends 81*b*) of the boss-shaped portions 81 are larger than twice the lengths D2 of the tubular portions 80 in the upward-downward direction ($D1>2\times D2$).

Outer edges 81*c* of the tip ends 81*b* (lower ends) of the boss-shape portions 81 each have a rounded and curved shape. The outer edges 81*c* of the tip ends 81*b* of the boss-shaped portions 81 have shapes that allow the outer edges 81*c* to be easily inserted into the tubular portions 80.

The operation to attach the engine hatch 3 to the deck 11 is now described.

First, as shown in FIG. 8, the inner hatch 4 and the outer hatches 5 are fixed to each other. Specifically, the outer hatches 5 are positioned with respect to the inner hatch 4 by the claws of the positioning and fixing portions 30, and the outer hatches 5 are fixed to the inner hatch 4 by the bolts of the positioning and fixing portions 30. Furthermore, in a state in which the outer fixing portions 50 are placed inside the inner fixing portions (boss-shaped portions 81) from above, the outer hatches 5 and the inner hatch 4 are fixed to each other by the bolts 82.

Then, as shown in FIG. 7, the front end movement restrictors 6 restrict movement of the front end 3*a* (see FIG. 3) of the engine hatch 3 with respect to the deck 11. Specifically, the engine hatch 3 is tilted such that the front end 3*a* of the engine hatch 3 is lower than the rear end 3*b* (see FIG. 3), and the hatch-side front end movement restrictors 61 (shafts 61*a*) engage with the wavy (plate-shaped) deck-side front end movement restrictors 60 from below.

Then, as shown in FIG. 6, the rear end movement restrictors 8 restrict horizontal movement of the rear end 3*b* of the engine hatch 3. Specifically, the engine hatch 3 is rotated about the shafts 61*a* as the center of rotation as the rear end 3*b* of the engine hatch 3 is lowered. Then, the pair of boss-shaped portions 81 of the engine hatch 3 are inserted into the pair of tubular portions 80 fixed to the deck 11 from above.

Finally, as shown in FIG. 9, the rear end lock 7 locks the engine hatch 3 so as to prevent removal of the engine hatch 3 from the deck 11 by restricting upward movement of the rear end 3*b* with respect to the deck 11. Specifically, the deck-side rear end lock 70 rotates to move above the hatch-side rear end lock 71 such that upward movement of the hatch-side rear end lock 71 (rear end 3*b*) is restricted.

According to the various preferred embodiments of the present invention described above, the following advantageous effects are achieved.

According to a preferred embodiment of the present invention, the rear end movement restrictors 8 are provided on the hatch (engine hatch 3) closer to the rear end lock 7 than the front end movement restrictors 6 in the forward-rearward direction and restrict horizontal movement of the rear end 3*b*. Accordingly, in a state in which the front end movement restrictors 6 restrict movement of a front portion of the hatch, and the rear end movement restrictors 8 restrict horizontal movement of a rear portion of the hatch, the rear end lock 7 locks the hatch with respect to the deck 11. Thus, in a state in which not only movement of the front portion of the hatch but also horizontal movement of the rear portion of the hatch is restricted, the rear end lock 7 locks the hatch with respect to the deck 11, and thus collision between the hatch and the deck 11 caused by horizontal swinging of the hatch due to vibrations during operation is significantly reduced or prevented. Consequently, sounds caused by collision between the hatch and the deck 11 due to vibrations during operation are significantly reduced or prevented. Furthermore, the pair of rear end movement restrictors 8 are provided on both sides of the rear end lock 7 in the right-left direction such that horizontal swinging of the hatch due to vibrations during operation is reliably significantly reduced or prevented.

According to a preferred embodiment of the present invention, the hatch includes the engine hatch to cover the engine storage chamber 12 provided in the boat body 1 from above. Accordingly, horizontal swinging of the engine hatch due to vibrations during operation is significantly reduced or prevented.

According to a preferred embodiment of the present invention, the pair of rear end movement restrictors 8 are provided in the vicinity of the rear end 3*b* of the hatch (engine hatch 3) on the right and left sides of the rear end lock 7. Accordingly, the rear end movement restrictors 8 are provided in the vicinity of the rear end 3*b* of the hatch, and thus the rear end movement restrictors 8 are positioned farthest from the front end movement restrictors 6 in the forward-rearward direction. Therefore, as compared with a case in which the rear end movement restrictors 8 are located in the vicinity of portions of the hatch forward of the rear end 3*b*, horizontal swinging of the rear portion of the hatch due to vibrations during operation is further significantly reduced or prevented. Consequently, sounds caused by collision between the hatch and the deck 11 due to vibrations during operation are effectively significantly reduced or prevented.

According to a preferred embodiment of the present invention, the pair of rear end movement restrictors 8 are located outward of the pair of front end movement restrictors 6 in the right-left direction. Accordingly, the pair of rear end movement restrictors 8 are spaced apart by a relatively large distance in the right-left direction, and thus horizontal swinging of the rear portion of the hatch (engine hatch 3) due to vibrations during operation is more reliably significantly reduced or prevented.

According to a preferred embodiment of the present invention, the pair of rear end movement restrictors 8 are provided in the vicinity of both sides of the hatch (engine hatch 3) in the right-left direction, respectively. Accordingly, the pair of rear end movement restrictors 8 are further spaced apart in the right-left direction, and thus horizontal swinging of the rear portion of the hatch due to vibrations during operation is more reliably significantly reduced or prevented.

According to a preferred embodiment of the present invention, the rear end movement restrictors 8 include the tubular portions 80 provided on one of the deck 11 and the hatch (engine hatch 3) and including the holes 80*a* that extend in the upward-downward direction, and the boss-shaped portions 81 provided on the other of the deck 11 and the hatch and inserted into the tubular portions 80 such that horizontal movement of the boss-shaped portions 81 is restricted. Accordingly, the boss-shaped portions 81 are easily inserted into the tubular portions 80 such that horizontal swinging of the hatch is significantly reduced or prevented. Thus, horizontal swinging of the hatch is easily significantly reduced or prevented.

According to a preferred embodiment of the present invention, the tubular portions 80 are separate from the deck 11 and are fixed to the deck 11, and the boss-shaped portions 81 are integral and unitary with the hatch (engine hatch 3). Accordingly, the tubular portions 80 are provided as structures on the deck 11 side without changing the shape of the deck 11. Furthermore, the boss-shaped portions 81 are provided together with the hatch, and thus the boss-shaped portions 81 are easily provided.

According to a preferred embodiment of the present invention, the hatch includes the engine hatch 3 to cover the engine storage chamber 12 provided in the boat body 1 from above, the engine hatch includes the inner hatch 4 and the outer hatches 5 located above the inner hatch 4, and the rear end movement restrictors 8 further include the fixing members (e.g., bolts 82) that fix the inner hatch 4 and the outer hatches 5 to each other, in addition to the tubular portions 80 and the boss-shaped portions 81. Accordingly, the inner hatch 4 and the outer hatches 5 are easily fixed to each other by the fixing members, which are the structures of the rear end movement restrictors 8.

According to a preferred embodiment of the present invention, the outer hatches 5 and the inner hatch 4 include the outer fixing portions 50 to which the fixing members (e.g., bolts 82) are attached and the hollow inner fixing portions, respectively, and are fixed to each other by the fixing members in a state in which the outer fixing portions 50 are placed inside the inner fixing portions from above, and the rear end movement restrictors 8 restrict horizontal movement of the rear end 3*b* of the engine hatch 3 by inserting the boss-shaped portions 81 that function as the inner fixing portions into the tubular portions 80 in a state in which the outer hatches 5 and the inner hatch 4 are fixed to each other by the fixing members. Accordingly, the inner fixing portions also function as the boss-shaped portions 81, and thus the structure is simplified as compared with a case in which the inner fixing portions and the boss-shaped portions 81 are provided separately.

According to a preferred embodiment of the present invention, the fixing members include the bolts 82 screwed into the outer fixing portions 50 from below in a state in which the bolts 82 are placed inside the tubular portions 80 so as to jointly fasten the inner hatch 4 and the outer hatches 5. Accordingly, the inner hatch 4 and the outer hatches 5 are easily jointly fastened (fixed to each other) by the bolts 82, which are general-purpose products.

According to a preferred embodiment of the present invention, the outer fixing portions 50 include the thicker portions 51 including the female screws into which the bolts 82 are screwed and are thickened in the direction in which the female screws extend. Accordingly, the large female screws 51*a* are provided due to the thicker portions 51, and thus the inner hatch 4 and the outer hatches 5 are more firmly fixed to each other.

According to a preferred embodiment of the present invention, the boss-shaped portions 81 each have a concave shape that is recessed upward, and include, at their tip ends 81*b*, the bolt head storage areas 81*a* to accommodate the heads of the bolts 82. Accordingly, the boss-shaped portions 81 are inserted deeper into the tubular portions 80 as compared with a case in which the lengths of the boss-shaped portions 81 are reduced by the sizes of the heads of the bolts 82. Therefore, the inserted states of the boss-shaped portions 81 into the tubular portions 80 are more reliably maintained.

According to a preferred embodiment of the present invention, both the hatch (engine hatch 3) and the tubular portions 80 are made of resin materials. Accordingly, the hatch (boss-shaped portions 81) and the tubular portions 80 are made of the same or similar materials, and thus wear of both the hatch (boss-shaped portions 81) and the tubular portions 80 due to contact is significantly reduced or prevented. Furthermore, the hatch and the tubular portions 80 are easily provided by injection molding of a resin using a mold.

According to a preferred embodiment of the present invention, the diameters D1 of the boss-shaped portions 81 are larger than the lengths D2 of the tubular portions 80 in the upward-downward direction. Accordingly, the diameters of the boss-shaped portions 81 are relatively large, and thus the strength of the boss-shaped portions 81 is enhanced.

According to a preferred embodiment of the present invention, the diameters D1 of the boss-shaped portions 81 are larger than twice the lengths D2 of the tubular portions 80 in the upward-downward direction. Accordingly, the boss-shaped portions 81 have larger diameters, and thus the strength of the boss-shaped portions 81 is effectively enhanced.

According to a preferred embodiment of the present invention, the outer edges 81*c* of the tip ends 81*b* of the boss-shaped portions 81 each have a rounded and curved shape. Accordingly, the outer edges 81*c* of the tip ends 81*b* of the boss-shaped portions 81, which are portions first inserted into the tubular portions 80, each have a rounded and curved shape such that the boss-shaped portions 81 are easily inserted into the tubular portions 80.

According to a preferred embodiment of the present invention, the boss-shaped portions 81 each have a tapered shape that gradually tapers toward the tip ends 81*b* of the boss-shaped portions 81, and the holes 80*a* of the tubular portions 80 gradually taper along the tapered boss-shaped portions 81. Accordingly, the tip ends 81*b* of the boss-shaped portions 81, which are portions first inserted into the tubular portions 80, are narrow, and thus the boss-shaped portions 81 are easily inserted into the tubular portions 80.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the jet propelled boat is preferably a one-seater in the preferred embodiments described above, the present invention is not restricted to this. In the present invention, the jet propelled boat may alternatively be a tandem seater.

While the jet propelled boat preferably does not include a seat in the preferred embodiments described above, the present invention is not restricted to this. In the present invention, the jet propelled boat may alternatively include a seat.

While the hatch preferably includes the engine hatch in the preferred embodiments described above, the present invention is not restricted to this. In the present invention, the hatch may alternatively include a hatch of a storage that stores a component different from the engine.

While the tubular portions and the deck are preferably separate from each other in the preferred embodiments described above, the present invention is not restricted to this. In the present invention, the tubular portions and the deck may alternatively be integral and unitary with each other.

While the boss-shaped portions and the hatch (inner hatch) are preferably integral and unitary with each other in the preferred embodiments described above, the present invention is not restricted to this. In the present invention, the boss-shaped portions and the hatch (inner hatch) may alternatively be separate from each other.

While the boss-shaped portions are preferably provided on the inner hatch in the preferred embodiments described above, the present invention is not restricted to this. In the present invention, the boss-shaped portions may alternatively be provided on the outer hatches.

While the fixing members preferably include bolts in the preferred embodiments described above, the present invention is not restricted to this. In the present invention, the fixing members may alternatively include fixing members other than bolts such as rivets.

While the tubular portions are preferably fixed to the deck by the rivets in the preferred embodiments described above, the present invention is not restricted to this. In the present invention, the tubular portions may alternatively be fixed to the deck by fixing members other than the rivets such as bolts.

While the tubular portions are preferably provided on the deck, and the boss-shaped portions are preferably provided on the hatch in the preferred embodiments described above, the present invention is not restricted to this. In the present invention, the tubular portions may alternatively be provided on the hatch, and the boss-shaped portions may alternatively be provided on the deck.

While the rear end movement restrictors are preferably located in the vicinity of the rear end of the hatch in the preferred embodiments described above, the present invention is not restricted to this. In the present invention, the rear end movement restrictors may alternatively be located forward of the vicinity of the rear end of the hatch.

While the pair of rear end movement restrictors are preferably located outward of the pair of front end movement restrictors in the right-left direction in the preferred embodiments described above, the present invention is not restricted to this. In the present invention, the pair of rear end movement restrictors may alternatively be located inward of the pair of the front end movement restrictors in the right-left direction.

While the pair of rear end movement restrictors are preferably located in the vicinity of both sides of the hatch in the right-left direction, respectively, in the preferred embodiments described above, the present invention is not restricted to this. In the present invention, the pair of rear end movement restrictors may alternatively be located inward of the vicinities of both sides of the hatch in the right-left direction, respectively.

While the hatch preferably includes a plurality of members (the inner hatch and the pair of outer hatches) fixed to each other in the preferred embodiments described above, the present invention is not restricted to this. In the present invention, the hatch may alternatively include one member.

While both the engine hatch and the tubular portions are preferably made of resin materials in the preferred embodiments described above, the present invention is not restricted to this. In the present invention, both the engine hatch and the tubular portions may alternatively be made of metal materials, for example. The engine hatch and the tubular portions may be made of different materials instead of the same or similar materials.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled boat comprising:

a boat body including a hull and a deck above the hull;

a hatch on the deck;

a pair of front end movement restrictors spaced apart from each other in a right-left direction in a vicinity of a front end of the hatch so as to restrict movement of the front end with respect to the deck;

a rear end lock provided in a vicinity of a rear end of the hatch to lock the hatch so as to prevent removal of the hatch from the deck by restricting upward movement of the rear end with respect to the deck; and a pair of rear end movement restrictors provided on the hatch closer to the rear end lock than the pair of front end movement restrictors in a forward-rearward direction, the pair of rear end movement restrictors being located on both sides of the rear end lock in the right-left direction so as to restrict horizontal movement of the rear end.

2. The jet propelled boat according to claim 1, wherein the hatch includes an engine hatch to cover from above an engine storage chamber provided in the boat body.

3. The jet propelled boat according to claim 1, wherein the pair of rear end movement restrictors are provided in a vicinity of the rear end of the hatch on right and left sides of the rear end lock.

4. The jet propelled boat according to claim 1, wherein the pair of rear end movement restrictors are provided outward of the pair of front end movement restrictors in the right-left direction.

5. The jet propelled boat according to claim 4, wherein the pair of rear end movement restrictors are provided in a vicinity of both sides of the hatch in the right-left direction, respectively.

6. The jet propelled boat according to claim 1, wherein the pair of rear end movement restrictors each include:

a tubular portion provided on one of the deck and the hatch and including a hole that extends in an upward-downward direction; and a boss-shaped portion provided on the other of the deck and the hatch and inserted into the tubular portion such that horizontal movement of the boss-shaped portion is restricted.

7. The jet propelled boat according to claim 6, wherein the tubular portion is separate from the deck and is fixed to the deck; and the boss-shaped portion is integral and unitary with the hatch.

8. The jet propelled boat according to claim 7, wherein the hatch includes an engine hatch to cover from above an engine storage chamber provided in the boat body;

the engine hatch includes an inner hatch and an outer hatch above the inner hatch; and the pair of rear end movement restrictors each further include a fixing member to fix the inner hatch and the outer hatch to each other.

9. The jet propelled boat according to claim 8, wherein the outer hatch and the inner hatch include an outer fixing portion to which the fixing member is attached and a hollow inner fixing portion, respectively, and are fixed to each other by the fixing member in a state in which the outer fixing portion is placed inside the inner fixing portion from above; and the pair of rear end movement restrictors restrict horizontal movement of the rear end of the engine hatch when the boss-shaped portion that functions as the inner fixing portion is inserted into the tubular portion in a state in which the outer hatch and the inner hatch are fixed to each other by the fixing member.

10. The jet propelled boat according to claim 9, wherein the fixing member includes a bolt screwed into the outer fixing portion from below in a state in which the bolt is placed inside the tubular portion so as to jointly fasten the inner hatch and the outer hatch.

11. The jet propelled boat according to claim 10, wherein the outer fixing portion includes a thicker portion including a female screw into which the bolt is screwed, and the thicker portion is thickened in a direction in which the female screw extends.

12. The jet propelled boat according to claim 10, wherein the boss-shaped portion has a concave shape that is recessed upward, and includes, at its tip end, a bolt head storage to accommodate a head of the bolt.

13. The jet propelled boat according to claim 7, wherein both the hatch and the tubular portion are made of a resin material.

14. The jet propelled boat according to claim 6, wherein the boss-shaped portion has a diameter larger than a length of the tubular portion in the upward-downward direction.

15. The jet propelled boat according to claim 14, wherein the diameter of the boss-shaped portion is larger than twice the length of the tubular portion in the upward-downward direction.

16. The jet propelled boat according to claim 6, wherein the boss-shaped portion includes a tip end including a rounded and curved outer edge.

17. The jet propelled boat according to claim 6, wherein the boss-shaped portion has a tapered shape that gradually tapers toward a tip end of the boss-shaped portion; and the hole of the tubular portion gradually tapers along the boss-shaped portion.

* * * * *